US008573697B1

(12) United States Patent
Su

(10) Patent No.: US 8,573,697 B1
(45) Date of Patent: Nov. 5, 2013

(54) COMBINATION OF A WAISTREST AND A BACKREST

(76) Inventor: Tung-Hua Su, Tainan (TW)

( * ) Notice: Subject to any disclaimer, the term of this patent is extended or adjusted under 35 U.S.C. 154(b) by 0 days.

(21) Appl. No.: 13/594,849

(22) Filed: Aug. 26, 2012

(51) Int. Cl.
*A47C 3/00* (2006.01)

(52) U.S. Cl.
USPC ..... 297/284.7; 297/452.18

(58) Field of Classification Search
USPC ..... 297/452.18, 284.7
See application file for complete search history.

(56) References Cited

U.S. PATENT DOCUMENTS 6,419,318 B1 * 7/2002 Albright ..... 297/284.7
6,957,861 B1 * 10/2005 Chou et al. ..... 297/284.7
7,104,604 B1 * 9/2006 Kang ..... 297/284.7
7,344,194 B2 * 3/2008 Maier et al. ..... 297/284.7
7,857,388 B2 * 12/2010 Bedford et al. ..... 297/284.7
2002/0096920 A1 * 7/2002 Watson et al. ..... 297/300.1

* cited by examiner

*Primary Examiner* — Sarah B McPartlin

(57) ABSTRACT

A combination includes front and rear frames each having a central hollow portion. The central hollow portion of the front frame includes two lateral sides each having a flexible plate with a plurality of vertically spaced positioning grooves. A guiding groove is defined in each of two lateral sides of the central hollow portion of the rear frame. A waistrest includes a support portion. A lug is formed on each of two sides of the support portion. A protrusion is formed on a rear face of each lug and is received in one of the guiding grooves of the rear frame. A positioning member is formed on the front face of each lug. Each flexible plate abuts the front face of one of the lugs. The positioning member of each lug of the waistrest is engaged in one of the positioning grooves of one of the flexible plates.

4 Claims, 9 Drawing Sheets

A-A

B-B

COMBINATION OF A WAISTREST AND A BACKREST

BACKGROUND OF THE INVENTION

The present invention relates to a combination of a waistrest and a backrest and, more particularly, to a backrest allowing easy assembly and easy adjustment/positioning of a waistrest.

A waistrest is provided on a chair to support the waist of a user for avoiding discomfort of the waist due to long-term sitting. The waistrest is generally fixed to a backrest of the chair and is, thus, not suitable for various users of various body sizes such that the waist of the user may not be well supported.

In an approach, a movable waistrest is mounted to the backrest by an adjustment knob through threading coupling. The adjustment knob can be loosened by a tool to allow adjustment of the position of the waistrest relative to the backrest and then tightened again by the tool through threading coupling. However, the adjustment is inconvenient to the user, as the tool is required to loosen/tighten the adjustment knob, and positioning of the waistrest is risky if the adjustment knob is not tightened.

BRIEF SUMMARY OF THE INVENTION

A combination of a waistrest and a backrest according to the present invention includes a front frame that is annular and made of rigid material. The front frame includes a central hollow portion having two lateral sides. Two flexible plates are provided on the lateral sides of the central hollow portion of the front frame. Each flexible plate includes a plurality of positioning members spaced in a vertical direction, with a positioning groove defined between two adjacent positioning members. The front frame is covered by a net that provides support for the central hollow portion of the front frame. A rear frame is annular and made of rigid material and is engaged with the front frame. The rear frame includes a central hollow portion having two lateral sides. A guiding groove is defined in each lateral side of the central hollow portion of the rear frame and extends in the vertical direction. Each guiding groove includes a front opening and upper and lower ends. Upper and lower stops are respectively formed on the upper and lower ends of each guiding groove. A waistrest includes a support portion having two sides. A lug is formed on each side of the support portion. Each lug includes a front face and a rear face. A protrusion is formed on the rear face of each lug and is received in one of the guiding grooves of the rear frame and limited by the upper and lower stops. A positioning member is formed on the front face of each lug. Each flexible plate abuts the front face of one of the lugs of the waistrest. The positioning member of each lug of the waistrest is engaged in one of the positioning grooves of one of the flexible plates.

The present invention will become clearer in light of the following detailed description of illustrative embodiments of this invention described in connection with the drawings.

DETAILED DESCRIPTION OF THE INVENTION

Figure 6:
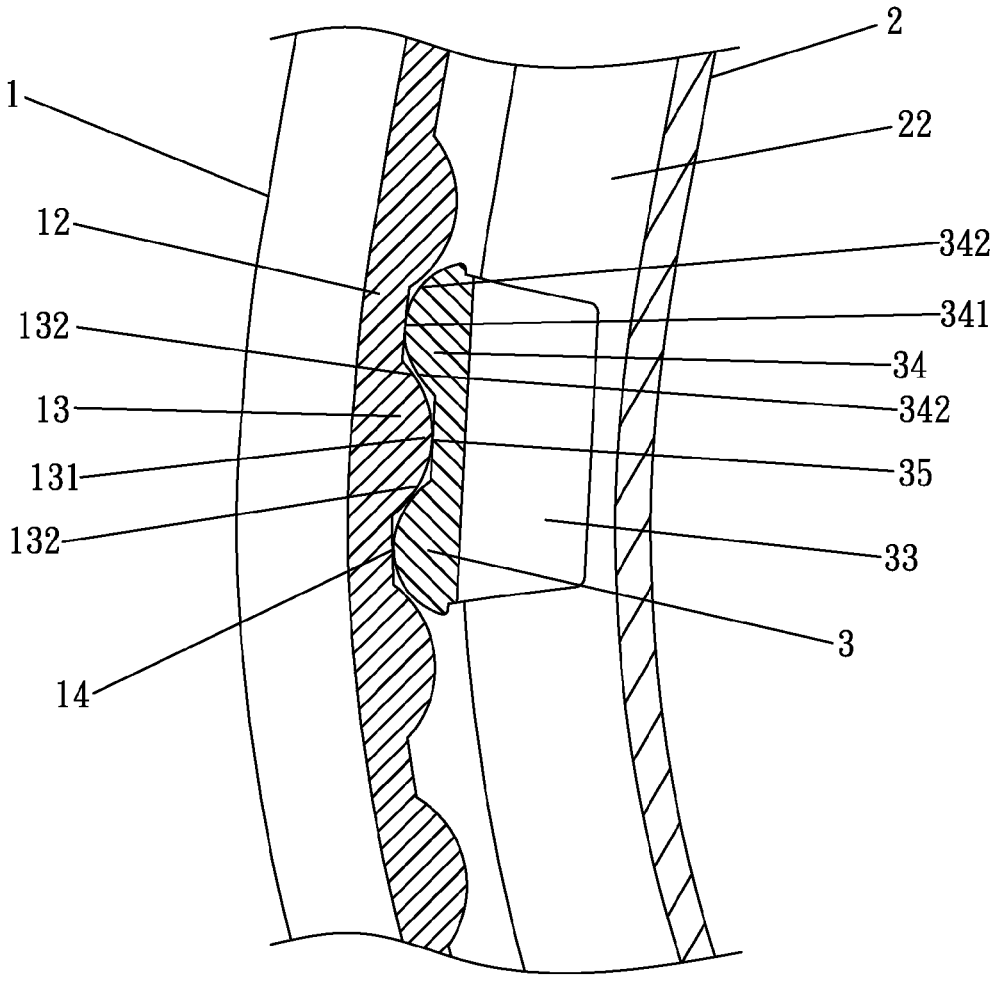
FIG. 6 shows a cross sectional view taken along section line A-A of FIG. 5.
Figure 7:
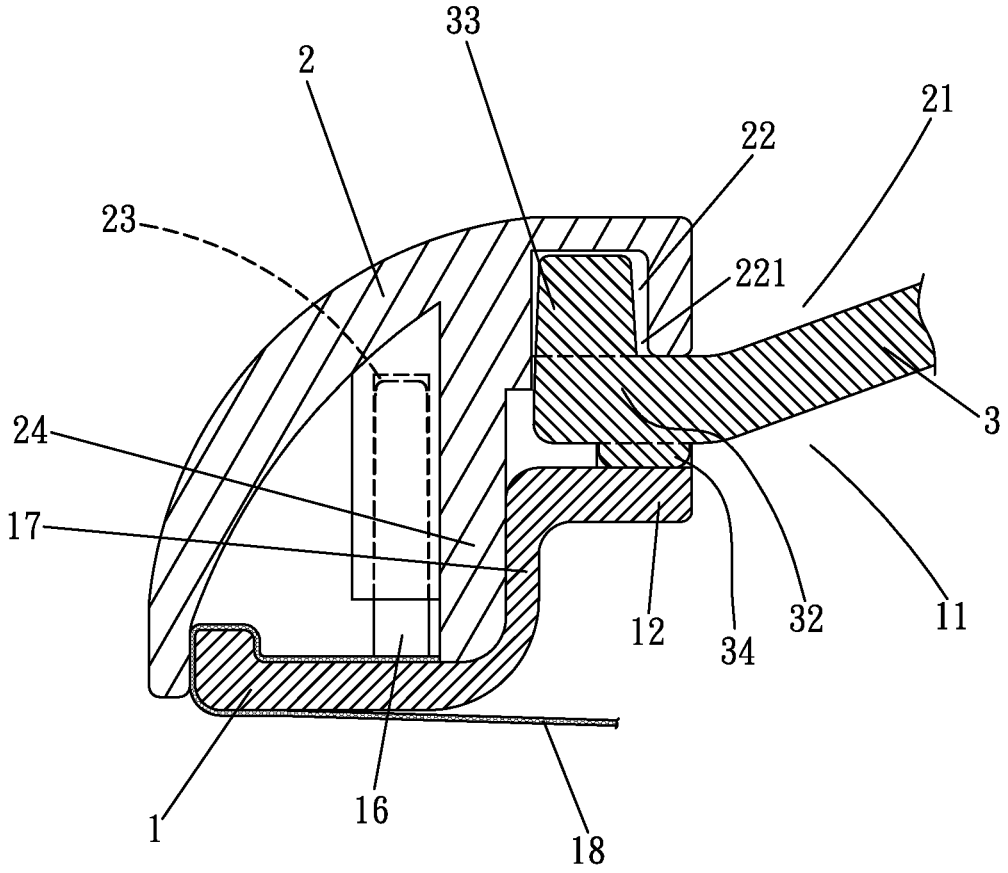
FIG. 7 shows a cross sectional view taken along section line B-B of FIG. 5.

With reference to FIGS. 1-4, a combination of a waistrest and a backrest according to the present invention includes a front frame 1, a rear frame 2, and a waistrest 3. The front frame 1 is annular and made of rigid material and includes a central hollow portion 11 having two lateral sides. Two flexible plates 12 are provided on the lateral sides of the central hollow portion 11 of the front frame 1. Each flexible plate 12 includes a plurality of positioning members 13 spaced in a vertical direction, with a positioning groove 14 defined between two adjacent positioning members 13. Each positioning member 13 includes upper and lower guiding faces 132 and a central bulge 131 located between the upper and lower arcuate guiding faces 132, as shown in FIG. 6. The front frame 1 includes a front surface 15 and a rear surface opposite to the front surface 15. A plurality of pegs 16 is formed on the rear surface of the front frame 1. An annular flange 17 is formed on the rear surface of the front frame 1 and includes a plurality of fixing holes 171. The front frame 1 is covered by a net 18 that provides support for the central hollow portion 11 of the front frame 1.

The rear frame 2 is annular and made of rigid material and includes a central hollow portion 21 having two lateral sides. A guiding groove 22 is defined in each lateral side of the central hollow portion 21 of the rear frame 2 and extends in the vertical direction. Each guiding groove 22 includes a front opening 221. Upper and lower stops 22 are respectively formed on upper and lower ends of each guiding groove 22. The rear frame 2 further includes a plurality of holes 23. The pegs 16 of the front frame 1 are engaged in the holes 23 of the rear frame 2. The rear frame 2 further includes an annular flange 24 abutting the annular flange 17 of the front frame 1 when the rear frame 2 is engaged with the front frame 1. The rear frame 2 further includes a plurality of fixing holes 241 aligned with the plurality of fixing holes 171 of the front frame 1. A plurality of pins 25 extends through the fixing holes 171 of the front frame 1 and the fixing holes 241 of the rear frame 2.

The waistrest 3 includes a support portion 31. A lug 32 is formed on each of two sides of the support portion 31 and includes a front face and a rear face. A protrusion 33 is formed on the rear face of each lug 32 and received in one of the guiding grooves 22 of the rear frame 2. First and second positioning members 34 are formed on the front face of each lug 32. Each flexible plate 12 abuts the front face of one of the lugs 32 of the waistrest 3. Each of the first and second positioning members 34 of each lug 32 of the waistrest 3 is engaged in one of the positioning grooves 14 of one of the flexible plates 12. A groove 35 is defined between the first and second positioning members 34. The groove 35 of each lug 32 is engaged with one of the positioning members 13 of one of the flexible plates 12. Each of the first and second positioning members 34 includes upper and lower guiding faces 342 and a central bulge 341 located between the upper and lower arcuate guiding faces 342.

Figure 1:
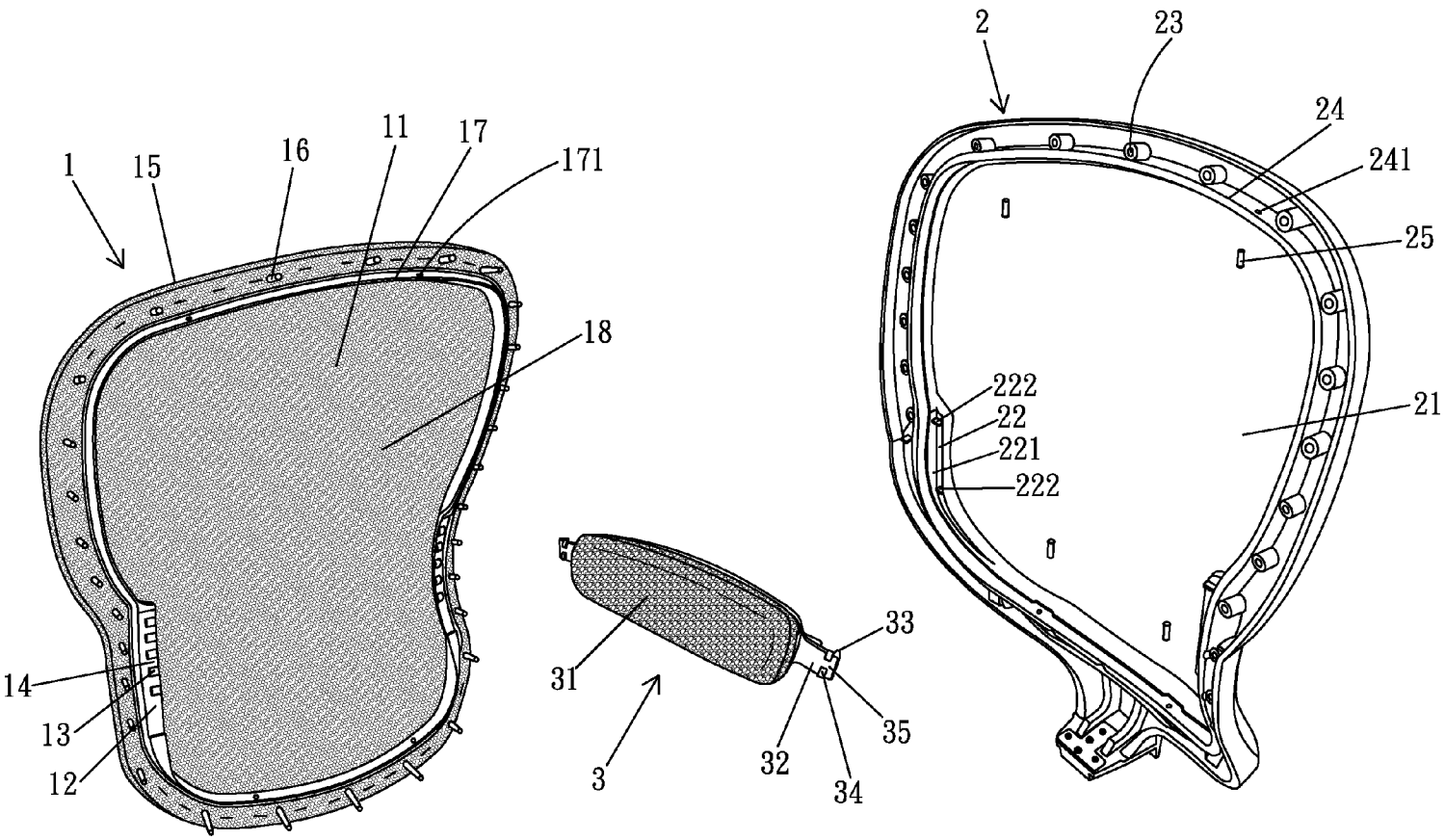
FIG. 1 shows an exploded, perspective view of a combination of a backrest and a waistrest according to the present invention.
Figure 2:
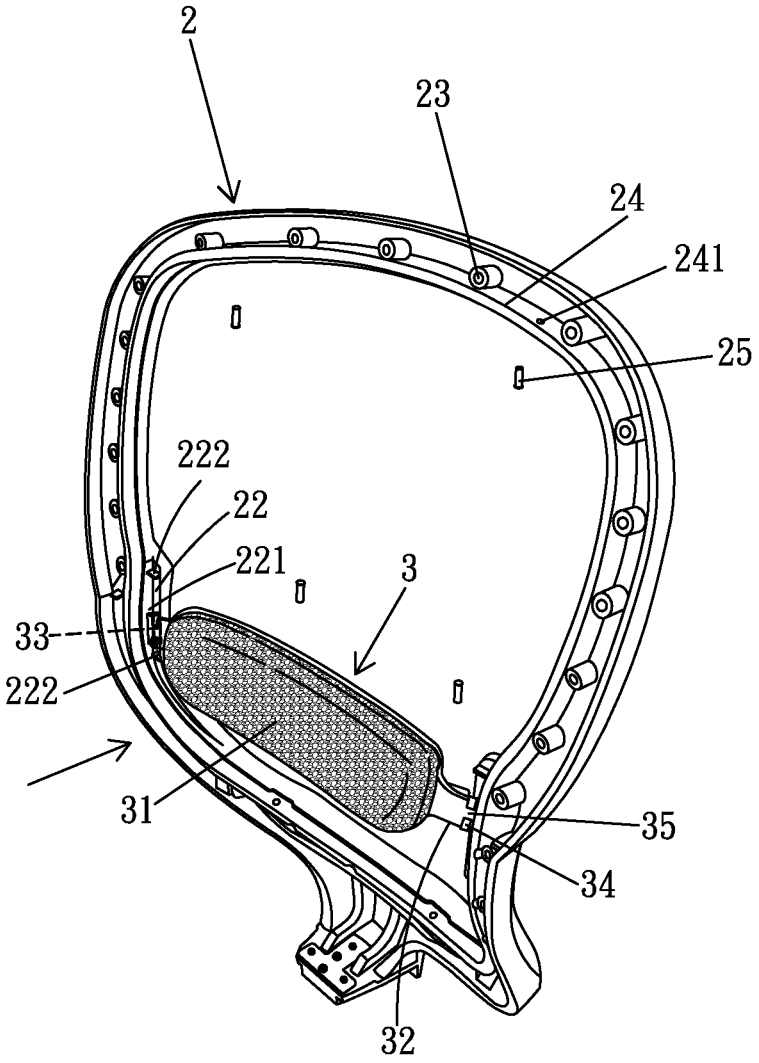
FIG. 2 shows a perspective view of the waistrest and a rear frame of FIG. 1.
Figure 3:
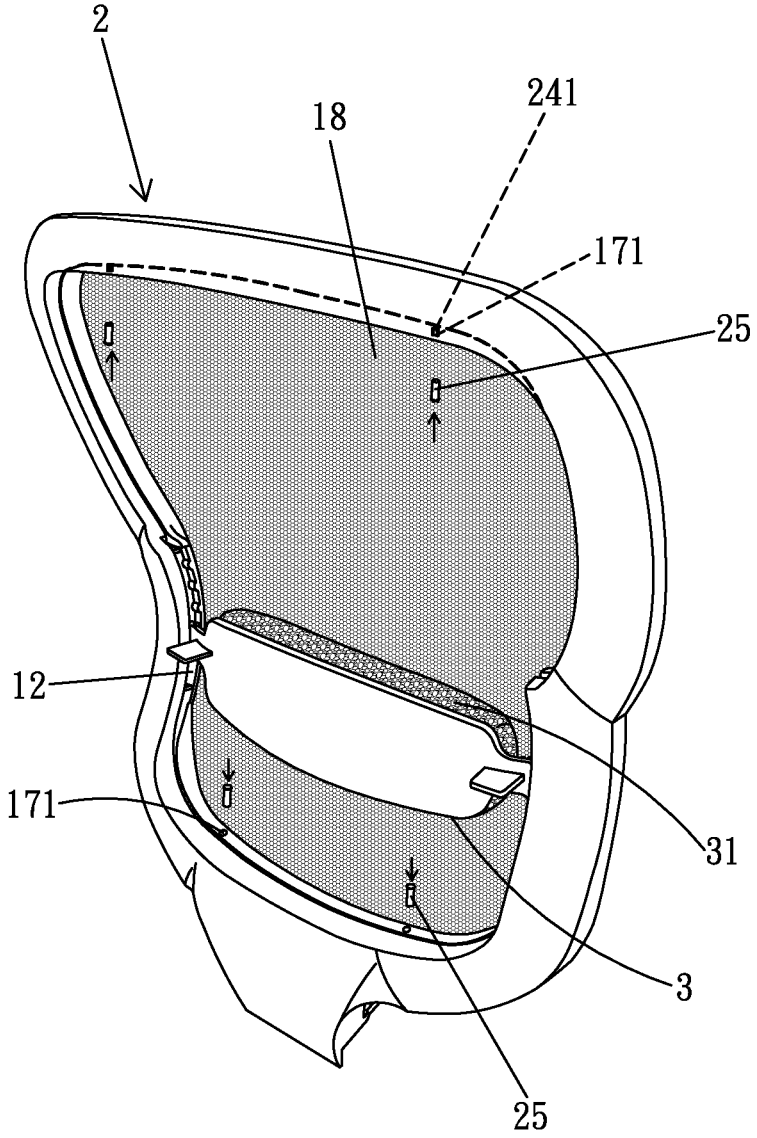
FIG. 3 shows a perspective view of the combination of FIG. 1.
Figure 4:
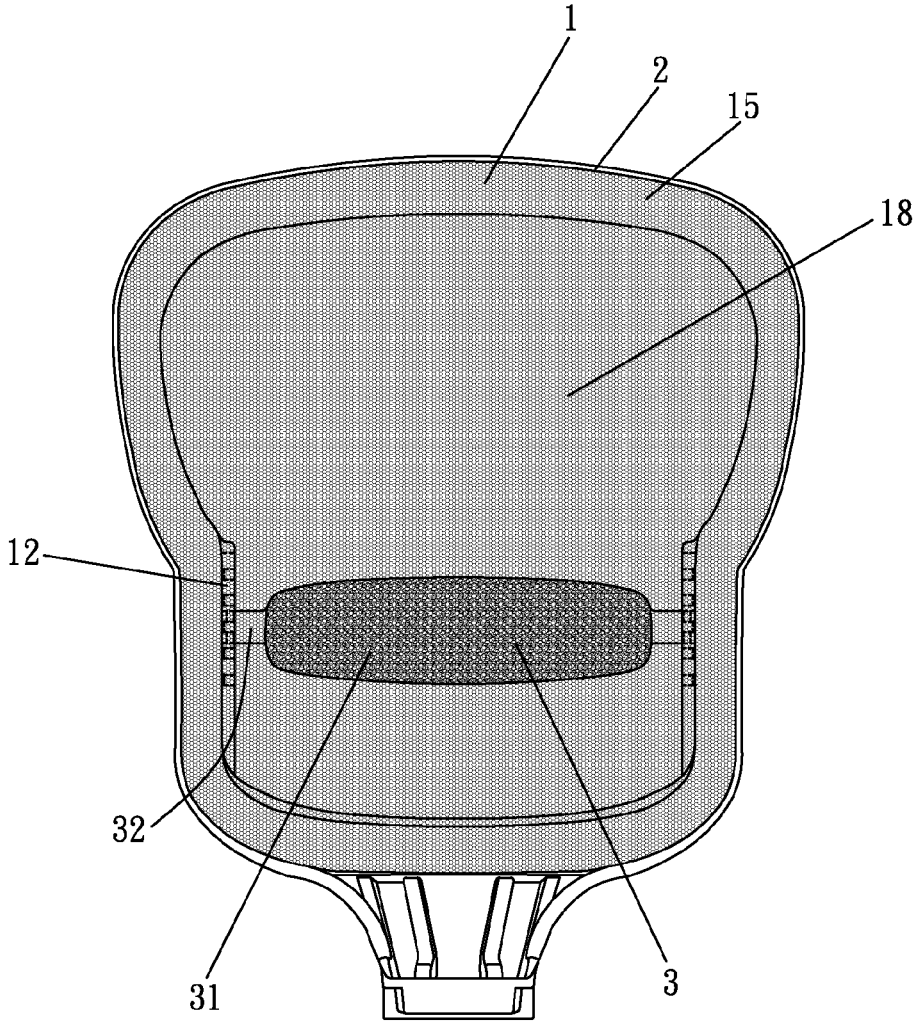
FIG. 4 shows a front view of the combination of FIG. 3.
Figure 5:
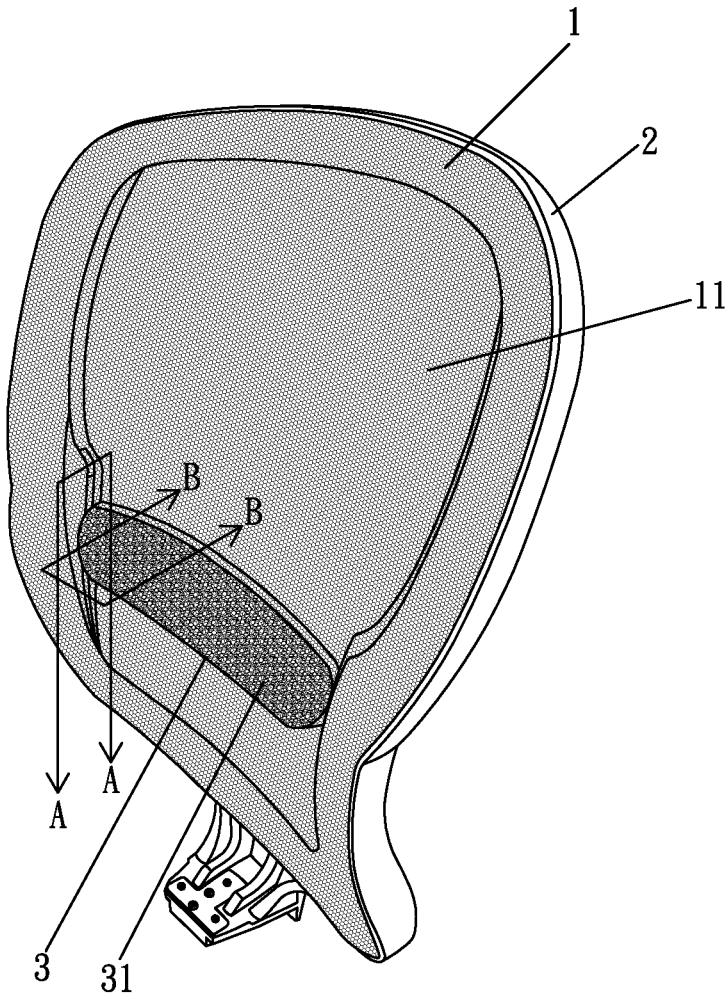
FIG. 5 shows a front, perspective view of the combination of FIG. 4.

With reference to FIG. 2, in assembly, the waistrest 3 is placed in front of the rear frame 2, with the lugs 33 received in the guiding grooves 22 of the rear frame 2. With reference to FIGS. 1-7, the front and rear frames 1 and 2 are engaged with each other, with the pegs 16 of the front frame 1 engaged in the holes 23 of the rear frame 2, with the annular flanges 17 of the front frame 1 abutting the annular flange 24 of the rear frame 2. Then, the pins 25 are extended through the fixing holes 171 of the front frame 1 and the fixing holes 241 of the rear frame 2, providing convenient assembly and reliability. The flexible plates 12 of the front frame 1 abut the front faces of the lugs 32 of the waistrest 3. The upper and lower stops 222 of each guiding groove 22 of the rear frame 2 restrain the protrusion 33 of the corresponding lug 32, preventing disengagement of the waistrest 3. The first and second positioning members 34 of the waistrest 3 and the positioning members 13 of the flexile plates 12 respectively engage with the positioning grooves 14 and the groove 35, providing double positioning effect.

Figure 8:
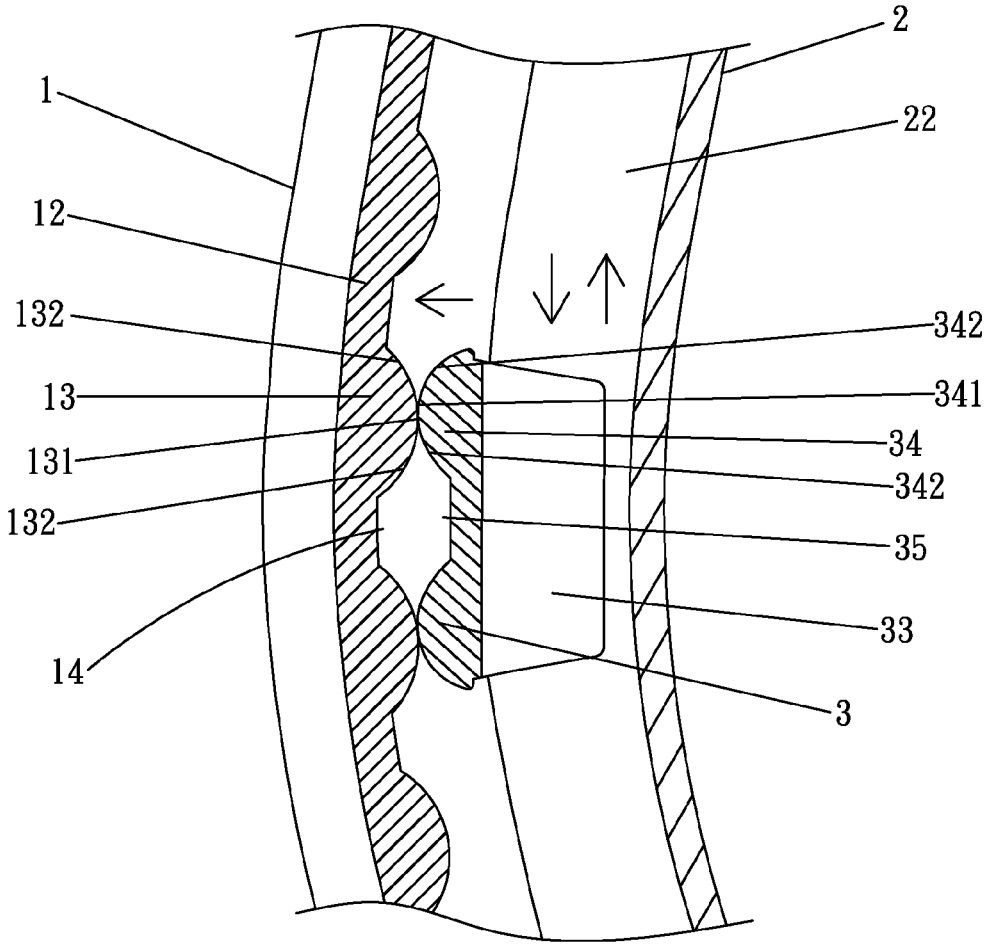
FIG. 8 shows a view similar to FIG. 6, illustrating adjustment of the waistrest.
Figure 9:
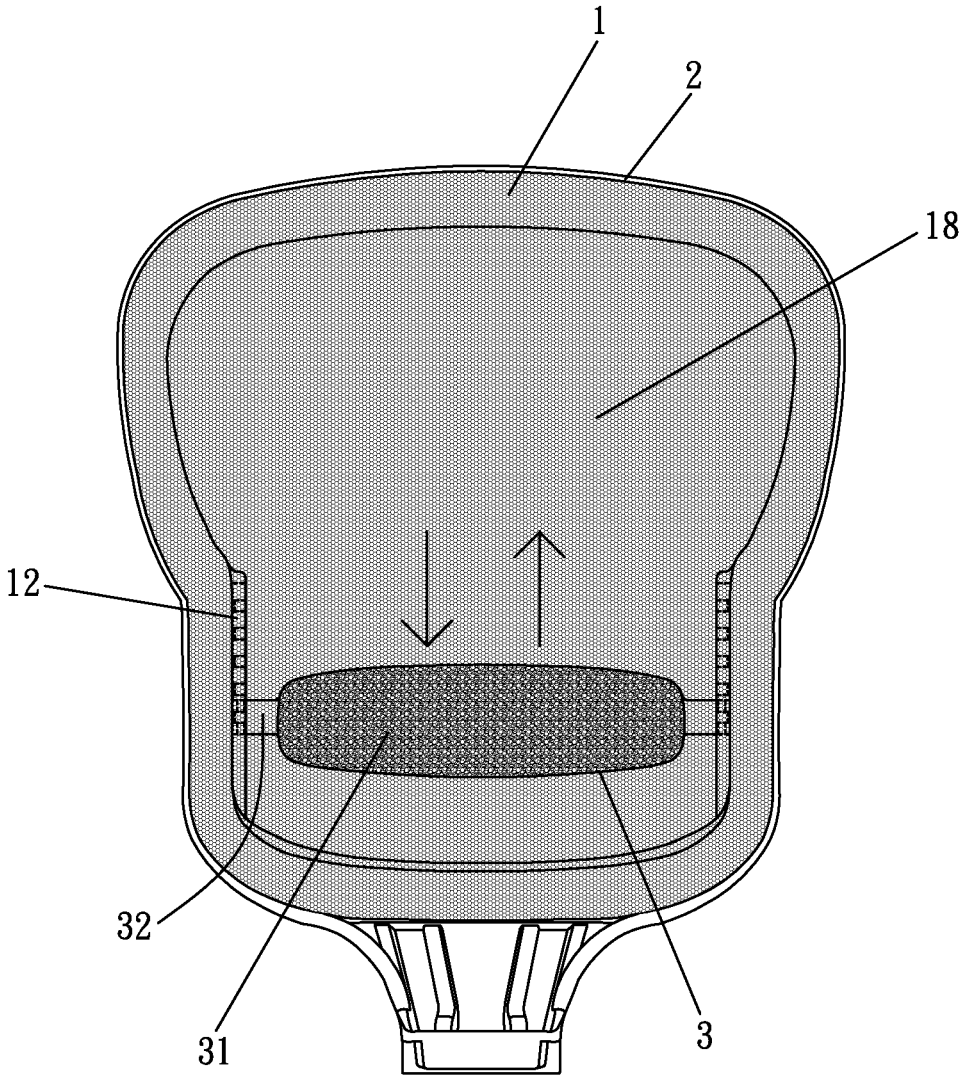
FIG. 9 shows a view similar to FIG. 4, illustrating adjustment of the waistrest.

With reference to FIGS. 8 and 9, when adjustment of the height of the waistrest 3 is required, a force is applied to the waistrest 3 to move the lugs 33 in the guiding grooves 22 in the vertical direction. Due to flexibility of the flexible plates 12, the flexible plates 2 move forward when the central bulges 341 of the first and second positioning members 34 abut the central bulges 131 of the positioning members 13, with the upper and lower arcuate guiding faces 142, 342 providing smooth movement. Then, the first and second positioning members 34 of the waistrest 3 and the positioning members 13 of the flexile plates 12 respectively engage with the positioning grooves 14 and the groove 35 aligned with the first and second positioning members 34 and the positioning members 13. The flexible plates 12 flex back to their initial position to retain the waistrest 3 after the height adjustment. Thus, the position of the waistrest 3 can be easily adjusted while providing reliable positioning.

Each lug 33 of the waistrest 3 can include only one of the first and second positioning members 34 if desired. The front and rear frames 1 and 2 can be secured to each other by bolts or other provisions.

Although specific embodiments have been illustrated and described, numerous modifications and variations are still possible without departing from the essence of the invention. The scope of the invention is limited by the accompanying claims.

The invention claimed is:

1. A combination of a waistrest and a backrest comprising:

a front frame that is annular and made of rigid material, with the front frame including a central hollow portion having two lateral sides, with two flexible plates provided on the two lateral sides of the central hollow portion of the front frame, with each of the two flexible plates including a plurality of positioning members spaced in a vertical direction, with a positioning groove defined between two adjacent positioning members, with the front frame covered by a net, with the net providing support for a user leaning against the backrest by spanning the central hollow portion of the front frame;

a rear frame that is annular and made of rigid material, with the rear frame engaged with the front frame, with the rear frame including a central hollow portion having two lateral sides, with a guiding groove defined in each of the two lateral sides of the central hollow portion of the rear frame and extending in the vertical direction, with each of the guiding grooves including a front opening and upper and lower ends, with upper and lower stops respectively formed on the upper and lower ends of each of the guiding grooves; and a waistrest including a support portion having two sides, with a lug formed on each of the two sides of the support portion, with each of the lugs including a front face and a rear face, with a protrusion formed on the rear face of each of the lugs, with the protrusion of each of the lugs received in one of the guiding grooves of the rear frame and limited by the upper and lower stops, with a first positioning member formed on the front face of each of the lugs, with each of the flexible plates abutting the front face of one of the lugs of the waistrest, with the first positioning member of each of the lugs of the waistrest engaged in one of the positioning grooves of one of the flexible plates.

2. The combination of a waistrest and a backrest as claimed in claim 1, with each of the lugs including a second positioning member, with a groove defined between the first and the second positioning member, with the groove of each of the lugs engaged with one of the plurality of positioning members of one of the flexible plates.

3. The combination of a waistrest and a backrest as claimed in claim 1, with each of the lugs including a second positioning member, with each of the first and the second positioning member including a central bulge and upper and lower guiding faces, with the central bulge located between the upper and lower arcuate guiding faces.

4. The combination of a waistrest and a backrest as claimed in claim 1, with the front frame including a front surface and a rear surface opposite to the front surface, with a plurality of pegs formed on the rear surface of the front frame, with an annular flange formed on the rear surface of the front frame, with the annular flange including a plurality of fixing holes, with the rear frame including a plurality of holes, with the plurality of pegs of the front frame engaged in the plurality of holes of the rear frame, with the rear frame further including an annular flange abutting the annular flange of the front frame, with the rear frame further including a plurality of fixing holes aligned with the plurality of fixing holes of the front frame, with a plurality of pins extending through the plurality of fixing holes of the front frame and the plurality of fixing holes of the rear frame.

* * * * *